US006010739A

United States Patent [19]

Ueberschär et al.

[11] Patent Number: 6,010,739

[45] Date of Patent: Jan. 4, 2000

[54] METHOD AND APPARATUS FOR DIRECT OR INDIRECT APPLICATION OF A LIQUID OR PASTY MEDIUM ONTO A TRAVELING MATERIAL WEB

[75] Inventors: Manfred Ueberschär, Nattheim; Anton Plomer, Heidenheim; Hans-Peter Sollinger, Heidenheim; Bernhard Kohl, Heidenheim, all of Germany

[73] Assignee: Voith Sulzer Papiermaschinen GmbH, Heidenheim, Germany

[21] Appl. No.: 08/926,823

[22] Filed: Sep. 10, 1997

[30] Foreign Application Priority Data

Sep. 12, 1996 [DE] Germany ..... 196 37 164

[51] Int. Cl.[7] ..... B05D 3/12; B05C 11/02; B05C 11/00

[52] U.S. Cl. ..... 427/8; 427/9; 427/356; 118/672; 118/679; 118/688; 118/712; 118/119; 118/126; 118/413

[58] Field of Search ..... 427/8, 9, 356, 427/359, 428; 118/665, 672, 688, 689, 690, 694, 679, 712, 713, 119, 126, 261, 249, 413

[56] References Cited

U.S. PATENT DOCUMENTS

| | | | |
|---|---|---|---|
| 4,651,672 | 3/1987 | Sommer | 118/126 |
| 4,732,776 | 3/1988 | Boissevain | 427/10 |
| 5,085,168 | 2/1992 | Sollinger | 118/126 |
| 5,138,970 | 8/1992 | Sollinger | 118/126 |
| 5,159,893 | 11/1992 | Rantanen | 118/227 |
| 5,338,361 | 8/1994 | Anderson et al. | 118/689 |
| 5,529,629 | 6/1996 | Beisswanger | 118/665 |
| 5,612,091 | 3/1997 | Paloviita et al. | 427/355 |

FOREIGN PATENT DOCUMENTS

| | | | |
|---|---|---|---|
| 0 387 412 B1 | 7/1993 | European Pat. Off. | B05C 11/04 |
| 0 701 022 A2 | 8/1995 | European Pat. Off. . | |
| 43 41 341 C1 | 3/1995 | Germany | B05C 11/02 |
| 295 10 486 U 1 | 6/1995 | Germany | B05C 11/04 |
| 295 20 678 U 1 | 12/1995 | Germany | B05C 11/02 |
| 2 252 926 | 8/1992 | United Kingdom . | |
| 2252926 | 8/1992 | United Kingdom . | |

*Primary Examiner*—Shrive Beck
*Assistant Examiner*—Michael Barr
*Attorney, Agent, or Firm*—Taylor & Associates, P.C.

[57] ABSTRACT

In a method for direct or indirect application of a liquid or pasty medium onto a traveling material web, notably of paper or cardboard, where during the application the cross profile (length profile) of the medium is modified under control and thereafter, in the direction of travel, the length profile (cross profile) of the previously applied medium is modified under control. Control of the cross profile and control of the length profile of the applied medium occur separately from one another in automatic control loops based on measurements of the applied profile. In addition is a pertaining apparatus with an applicator, an equalizer, a pertaining cross profile control loop, and a pertaining length profile control loop.

12 Claims, 2 Drawing Sheets

- - - - First independent control loop for cross profile with applicator

——— Second independent control loop for length profile with doctor element

METHOD AND APPARATUS FOR DIRECT OR INDIRECT APPLICATION OF A LIQUID OR PASTY MEDIUM ONTO A TRAVELING MATERIAL WEB

BACKGROUND OF THE INVENTION

1. Field of the Invention.

The present invention relates to a method and apparatus for direct or indirect application of a liquid or pasty medium onto a traveling material web, notably of paper or cardboard.

2. Description of the Related Art.

Known from German Patent Document No. 44 32 177 A1 is an applicator system for direct or indirect application of a liquid or pasty medium onto a traveling material web. The described applicator system is one with an open-jet nozzle formed by two oblong lip elements. The metering slot of the open-jet nozzle, that is, the clearance between the two lip elements, allows zonewise adjustment across the length of the lip elements, i.e., across the width of the material web to be coated. Hence, the amount of application of the liquid or pasty medium can be metered differently zonewise on the open-jet nozzle.

To that end, a plurality of adjustment apparatuses are provided, which are distributed across the length of the lip elements and act at least on one of the two lip elements of the open-jet nozzle. Also provided is an automatic control loop which readjusts the adjustment apparatuses on the basis of measured values of the cross profile of the applied liquid or pasty medium. The open-jet nozzle applicator system may also be followed by a precision metering apparatus which, by means of a doctor element, for example a doctor blade, removes liquid or pasty medium applied at surplus to the desired final cross profile.

The unpublished patent application No. 196 05 183.5 describes a method for control of the cross profile of the applied liquid or pasty medium existing across the width of the material web, the method relating to an applicator system such as explained above. Two control loops are provided, one of which effects a first correction of the cross profile directly on the open-jet nozzle. The second control loop effects on the precision metering apparatus a second and final correction of the cross profile of applied liquid or pasty medium. The two corrections are meant to supplement one another in their effect to obtain a desired overall correction of the cross profile. While a desired cross profile of relatively high accuracy is obtained with the proposed method, the control-related expense required, in addition to the mechanical expense, is considerable.

SUMMARY OF THE INVENTION

The present invention simplifies the control of the profile of an applied liquid or pasty medium.

The invention is based on the idea of separating the control of the cross profile from the control of the length profile. In a first embodiment of the present invention, the control of the cross profile of applied liquid or pasty medium occurs directly in the medium application, and the control of the length profile of applied liquid or pasty medium occurs thereafter, that is, afterwards in the direction of travel, on the previously applied medium. In a second embodiment, the control of the length profile of the applied liquid or pasty medium occurs directly with the application of the medium, and the control of the cross profile of the applied liquid or pasty medium occurs afterwards, in the direction of travel, on the previously applied medium. The cross profile is in the first variant controlled by an appropriate, zonewise different metering in the application of the medium, while the length profile is controlled in a subsequent operation, on the previously applied medium. The length profile in the second variant is controlled by an appropriate overall metering in the process of applying the medium, while the cross profile is controlled in a subsequent operation by zonewise modification of the previously applied medium. Thus, the two embodiments differ in principle only in that, based on the direction of travel of the pertaining system, the cross profile and the length profile are modified in spatially reversed order.

The cross profile of the applied medium is the contour of the applied coating in the cross direction of the material web, i.e., across the width of the material web. The length profile relates to the pattern of coating in the length direction of the material web, that is, in the direction of web travel. In producing the length profile, the final, so-called coating weight is adjusted, aiming to observe for the traveling material web a preset average amount of application per unit area of the material web.

According to the invention it was recognized that in the first embodiment of the invention a cross profile adjusted directly in the application of the medium is practically hardly adulterated, which would be a concern, by the subsequent adjustment of the length profile, for example by means of an equalizer apparatus. It must be taken into account that part of the liquid or pasty medium applied with a specific cross profile penetrates the material web with that cross profile before the equalizer for length profile adjustment is reached. Hence, as far as the part of the medium that has already penetrated the material web, the length profile adjustment apparatus is no longer able to alter the cross profile. Besides, it must be realized that the part of the applied medium that has not yet penetrated the material web generates on the doctor element of the equalizer, on which the length profile is adjusted, a hydrodynamic force acting opposite to the adjustment force. This hydrodynamic counterforce differs in size across the width of the material web in accordance with the previously adjusted cross profile so that, for example, an adjusted "hill" in the cross profile may be altered somewhat at the equalizer, but not eliminated, since the hydrodynamic counterforce is correspondingly greater there. Corresponding aspects apply also to the second embodiment of the invention.

The two embodiments of the invention involve in their practical application a certain mutual effect, or feedback, between successive control stations for the relevant control of length and cross profiles. This certain feedback will occur, possibly with different intensity, in both directions, that is, from the length profile control to the cross profile control and vice versa. An effect on the cross profile by the length profile control station can be balanced accordingly at the cross profile control station and vice versa. Especially in the system start-up, an operating state first needs to be tuned. This may still require on both control stations, i.e., on the length profile control station and the cross profile control station, a zonewise different adjustment. Once the system has been ramped up and tuned, a zonewise different, i.e., locally different across the width of the material web, modification is then effected during operation only on the cross profile control station. On the length profile control station only an overall control is performed across the width of the material web. The control process is thus distinctly simplified according to the invention.

The control of the final profile of the liquid or pasty medium applied onto a traveling material web is simplified by the methods according to the invention, since the cross profile adjustment is separated from the length profile adjustment and the latter can be carried out at reduced expense. This is because during operation the length profile adjustment apparatus, after its zonewise basic adjustment, only needs to be readjusted as a whole, in order to regulate the average coating weight.

The inventional methods can be employed both in the direct and indirect application of a liquid or pasty medium onto a traveling material web consisting of paper, cardboard, a textile material or the like. In the direct application, a liquid or pasty medium is applied directly onto the surface of a traveling material web which in the area of the point of application is supported by a revolving countersurface. Such revolving countersurface is formed by the shell surface of a rotating backing roll, the surface of a revolving endless belt or the like. In the indirect application, the liquid or pasty medium is first applied directly onto the surface of a revolving application substrate. Such revolving application substrate is configured as the shell surface of a rotating applicator roll, as the surface of a revolving endless applicator belt or the like. From the surface of the revolving application substrate, for example from the shell surface of an applicator roll, the applied medium is transferred in a nip to the surface of a material web. Such nip, hence, is formed between an applicator roll and a backing roll or, for example, also between an endless applicator belt and an endless backing belt, and the material web passes through the nip so as to transfer the medium to the material web.

In the first inventional method, the cross profile across the width of the material web is modified during the application directly on the material web, or is first modified during the application on an application substrate under zonewise control. Hence, this modification takes place by a zonewise different metering of the amount of application directly on the applicator, for example, in the case of an open-jet nozzle applicator system, by a zonewise different adjustment of the nozzle slot. The inventional method can be employed for different types of application; for example, for an application of the medium in an open jet, for an application of the medium by means of a doctor element, for an application of the medium by means of a scoop roll, and comparable types of application.

Following the application of the liquid or pasty medium onto the material web, or first on the application substrate, a controlled modification of the previously applied medium is inventionally effected thereafter for adjustment of the coating weight length profile. Hence, the applied medium adjusted previously in its cross profile is stripped somewhat, facultatively as a whole, for example by means of a doctor element, so as to regulate the desired final coating weight, using a doctor blade, doctor bar, or roll bar doctor as doctor element. Instead of a doctor element, an air knife or other equalizer element known in expert circles may also be used.

In the inventional method, the control of the cross profile and the control of the length profile of the applied medium take place separately of one another in automatic control loops. These loops are based on measurement of the profile of the medium applied finally on the surface of the material web or on the surface of the application substrate; that is, the measurements are taken after the point where the length profile is modified, or the measurements may follow the point of application directly. The measured actual values of the applied profile are continually compared, aided by computer, to preset profile setpoints. Resulting deviations are converted to appropriate separate control instructions to modify the cross profile and to modify the length profile.

The second inventional method operates analogously to the first inventional method explained above, but an overall metering of the amount of application is carried out at the applicator, so as to modify the length profile directly during the application. A subsequent zonewise modification of the applied medium occurs by means of an equalizer element, in order to modify the cross profile of the medium.

An inventional apparatus for the application of the first inventional method is configured as follows. Provided for application of a liquid or pasty medium is an applicator system designed as open-jet nozzle applicator; but it may also be configured as a doctor element/pressure chamber applicator system, a doctor element/sump applicator system or other applicator system known as such. The applicator is coordinated with a revolving countersurface that supports the traveling material web being coated. As explained above, the revolving countersurface may be configured as a rotating backing roll, revolving endless belt or similar. In the case of indirect application, the applicator is coordinated with a revolving application substrate, that is, a rotating applicator roll, a revolving endless belt or the like. From the surface of the revolving application substrate the medium is transferred to the traveling material web in a transfer nip, through which the web passes. The amount of medium application is metered, zonewise independently, across the web width directly on the applicator, by means of appropriate adjustment apparatuses. Such adjustment apparatuses, or adjustable metering apparatuses, are known as such and explained, e.g., in the initially mentioned German Patent Document No. 44 32 177 A1.

Following the applicator is an equalizer apparatus, which in the case of direct medium application is coordinated either with the same countersurface with which the applicator is coordinated, or is coordinated with a separate countersurface of its own. In the case of indirect medium application, the equalizer is coordinated with the revolving application substrate. The equalizer allows zonewise independent adjustment across the width of the material web, in order to be able to make a basic adjustment in the start-up of the apparatus. Moreover, the equalizer is adjustable as a whole in relation to the coordinated countersurface or the coordinated application substrate, so as to be able to make the length profile adjustment during operation. As explained above, such an equalizer includes a doctor element, for instance a doctor blade, an air knife or a comparable device. According to the invention, the equalizer thus includes a basic adjustment apparatus allowing a zonewise basic setting merely in the system start-up as well as an overall adjustment apparatus allowing a necessary readjustment of the previously adjusted equalizer during operation.

Additionally, the inventional apparatus includes a measuring system for acquisition of the cross profile of the applied medium. The measuring system includes a frame with a plurality of sensors assembled to it across the web width, and it follows the equalizer or directly the point of application. The continual measurement of the cross profile covers also the length profile of the passing material web. Also provided is a computer-aided automatic controller that forms control loops with the measuring system, the metering system and the equalizer. According to the invention, the measuring system, the controller and the metering system of the applicator form a first independent control loop for controlling the cross profile of the applied medium. The measuring system, the controller and the overall adjustment apparatus of the equalizer form a second independent control loop for controlling the length profile of the applied medium. According to the invention, the equalizer can be built and operated at relatively low expense, making appropriate cost savings achievable.

According to the invention, a single controller may be provided which effects a separate control of the cross profile adjustment at the metering system of the applicator, and of the length profile adjustment on the overall adjustment apparatus of the equalizer, in accordance with the two independent control loops. In another embodiment of the inventional apparatus, the controller may be divided in a cross profile controller and a length profile controller, the former being coordinated with the cross profile control loop and the latter with the length profile control loop.

An inventional apparatus for the application of the second inventional method differs from the apparatus for the application of the first inventional method as explained above in that an overall metering system is provided on the applicator, so as to modify the length profile by way of modifying the amount of medium application effective across the entire width of the material web, for example, by variation of the amount pumped. Also a zonewise adjustable basic metering system is provided on the applicator, allowing a basic setting of the applicator in the start-up of the system. The basic metering system and the overall metering system may be combined in design, for example, such that on the applicator there is a zonewise adjustable metering system provided which during operation is adjusted only as a whole. Moreover, the apparatus for the application of the second inventional method differs in that the equalizer allows a zonewise adjustment across the width of the material web in order to modify the cross profile of the medium. Otherwise, analogous to the apparatus for the application of the first inventional method as a explained above, there are two different control loops provided, namely a length profile control loop and a cross profile control loop. The length profile control loop includes the measuring system, the controller and the overall metering system of the applicator. The cross profile control loop includes the measuring system, the controller and the zonewise adjustable adjustment apparatus of the equalizer.

Also multiple inventional apparatuses may be arranged successively within one system, in order to perform the coating of the traveling material web in several partial operations.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
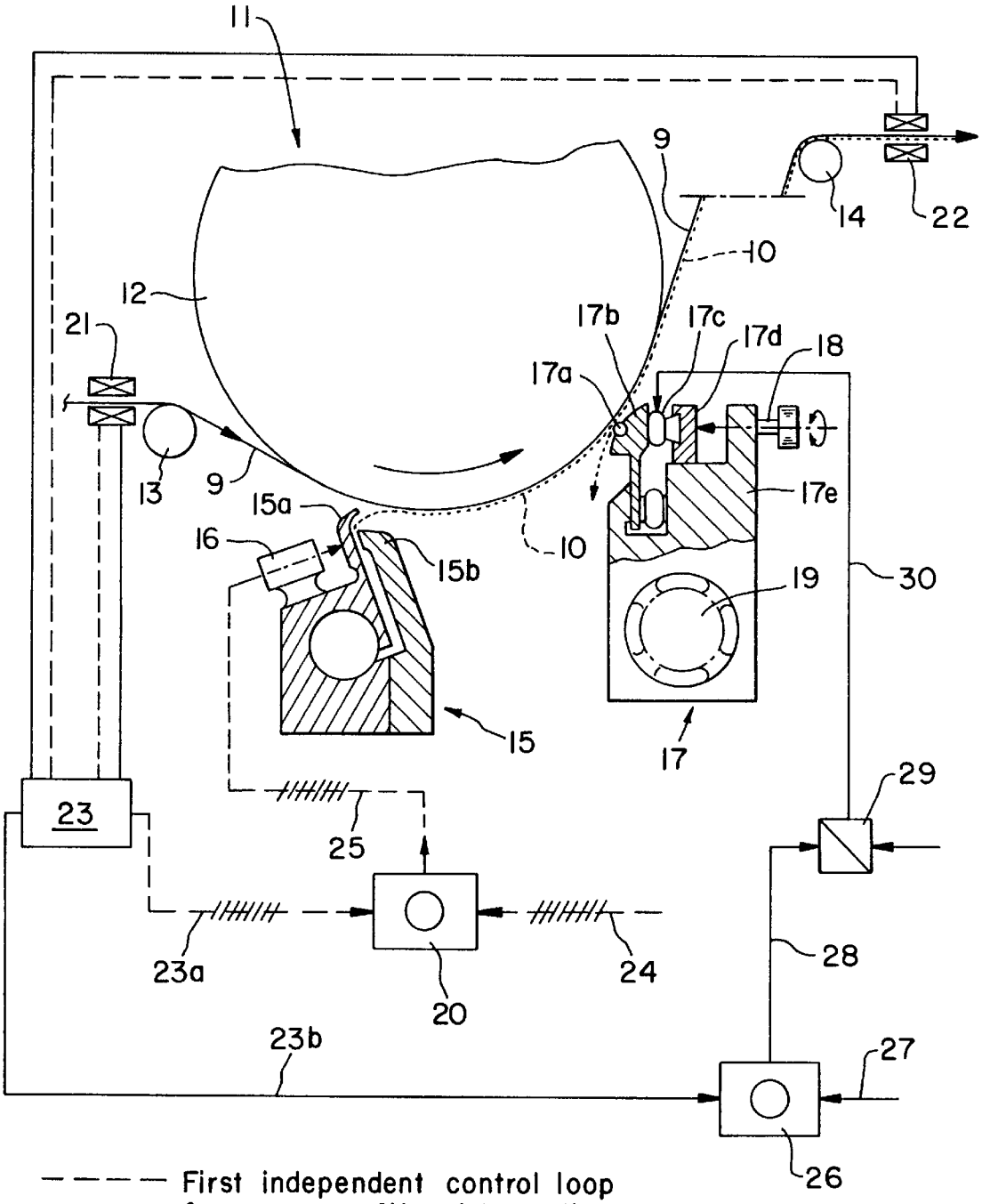
FIG. 1 is a schematic end view of a first embodiment of the apparatus according to the invention.

Referring now to the drawings and particularly to FIG. 1, there is shown an applicator system referenced 11 overall including an applicator 15, an equalizer 17 as well as a backing roll 12. Backing roll 12 rotates in arrow direction, supporting on its shell surface, along a support section, a traveling paper web 9. The direction of travel of paper web 9 is indicated by arrows. On the approach to applicator system 11, that is, at the left in FIG. 1, paper web 9 approaches via a web guide roll 13. On the leaving end of applicator system 11, that is, at the right in FIG. 1, paper web 9 departs after coating by way of a web guide roll 14. Applicator 15 is coordinated with paper web 9 being coated in the area where the paper web is supported by backing roll 12.

Applicator 15 is configured in known manner as an open-jet nozzle applicator. A liquid or pasty medium 10 to be applied onto traveling material web 9 is applied on the paper web in the form of an open jet from a metering slot formed between the two lips 15*a*, 15*b*. Indicated by dotted line in FIG. 1, medium 10 is, for example, a pigmented coating color, an impregnating fluid or starch. Applicator 15 is equipped with an adjustment apparatus 16 known as such, allowing zonewise independent adjustment of the metering slot between lips 15*a*, 15*b* across the width of the paper web. For that purpose, for example automatically actuated spindles are distributed across the length of the metering nozzle. The individual spindles locally adjust the one lip element in relation to the other, altering the width of the slot.

Viewed in the direction of travel of paper web 9, equalizer 17 is arranged after applicator 15 and coordinated as well with an area in which the paper web is supported by backing roll 12. Equalizer 17 is equipped in known manner with a roll doctor 17*a* mounted rotatably in a doctor bed 17*b*. The doctor assembly 17*a*, 17*b* is fitted on a support beam 17*e*. A pressure hose 17*c* is provided between a backing strip 17*d* and a back surface of the doctor bed 17*b*. The interior of pressure hose 17*c* is filled with compressed air whose pressure level may be adjusted. As a result, doctor assembly 17*a*, 17*b* is by variation of the pressure level in pressure hose 17*c* forced, more or less heavily as needed, on paper web 9 coated previously with medium 10. Equalizer 17 is additionally equipped with an adjustment apparatus 18 allowing a zonewise different basic setting of the contact force of roll doctor 17*a* across the width of paper web 9. Adjustment spindles are distributed across the length of equalizer 17 so as to act on a back surface of backing strip 17*d*, and thus ultimately on the roll doctor 17*a*, locally differently. Adjustment apparatus 18 need not be actuable automatically, since it serves only to adjust a basic setting in the start-up of the system. Provided additionally in FIG. 1 is a flexure compensator 19 for support beam 17*e*. Such flexure compensator, if needed, may be provided, of course, also in applicator 15.

Disposed before web guide roll 13 is a measuring station 21, which by means of appropriate sensors measures in known manner the starting profile of paper web 9 across its width, before the paper web then proceeds through applicator system 11. A further measuring station 22 is provided after web guide roll 14; it measures the profile of paper web 9 across its width after coating with medium 10 in applicator system 11. Normally, second measuring station 22 is provided only after a (not illustrated) dryer, so as to capture the dry-coating result at the measuring station. Both measuring stations 21, 22 transmit their measured values continually to a computer 23, which determines the cross profile of applied medium 10 across the width of paper web 9. Obtained by the continual cross profile detection is also the length profile of the coating with medium 10 for passing paper web 9.

Computer 23 connects via lines 23*a* to a controller 20. Furthermore, controller 20 receives via lines 24 the set values for the cross profile of the coating medium. Controller 20 connects via lines 25 to adjustment apparatus 16.

Additionally, computer 23 connects via a line 23*b* to a controller 26. Controller 26 receives via a line 27 the set value for the length profile of coating medium 10 in the traveling direction of paper web 9. Controller 26 connects via a line 28 to a transmitter 29 which, in turn, connects via a line 30 to pressure hose 17*c*.

The following explains now the function of the first embodiment relative to FIG. 1. Liquid or pasty medium 10 is by way of applicator 15 applied in an open jet on the traveling paper web 9, in accordance with a preset cross profile, metered differently across the width of the web. Next, roll doctor 17*a* strips at the equalizer 17, in accordance with a preset length profile, a specific amount of the previously applied medium 10. The removed medium 10 is indicated by an arrow on the roll doctor 17*a*. The cross profile is adjusted on applicator 15, the length profile on equalizer 17.

The actual coating result on paper web 9 is constantly monitored by measuring stations 21, 22. Computer 23 calculates from the measured values constantly obtained there the actual values for the cross profile of the coating medium as well as the actual value for the length profile of the coating medium.

The cross profile is readjusted as needed in a first independent control loop formed of measuring stations 21, 22, computer 23, controller 20 and adjustment apparatus 16 as well as the pertaining lines. To that end, controller 20 continually receives from computer 23 via lines 23*a* the measured actual values of the cross profile. The actual values are compared to the preset set values for the cross profile, which controller 20 receives via lines 24. Deviations between the actual values and the set values are converted to appropriate correcting quantities that are passed on to adjustment apparatus 16 via lines 25. Appropriate local adjustment of the metering slot width are made there. Thus, the local amount of application is readjusted across the web width, maintaining the preset desired cross profile.

A second independent control loop formed of measuring stations 21, 22, computer 23, controller 26, transmitter 29 and pressure hose 17*c* serves to control the length profile of coating medium 10. Controller 26 continually receives from computer 23 the actual value of the length profile. The value is compared constantly with the set value for the length profile, which controller 26 receives via line 27. A deviation between the actual value and the set value of the length profile is converted to an appropriate correcting quantity, which via line 28 is passed on to transmitter 29. The correcting quantity is converted at the transmitter 29 to an appropriate pressure change in pressure hose 17*c*, transmitted to pressure hose 17*c* via fluid pressure line 30. Due to the pressure change in pressure hose 17*c*, roll doctor 17*a* is as a whole forced onto paper web 9 with accordingly greater or smaller intensity and, consequently, removes more or less coating medium 10.In the operation of the system, thus, the basic setting of adjustment apparatus 18 is retained, and the length profile is readjusted only via pressure hose 17*c*.

In case the adjustment of the metering slot width on applicator 15 takes place pneumatically, hydraulically or in a similar way via adjustment apparatus 16, a transmitter may also be incorporated between controller 20 and adjustment apparatus 16, which transmitter converts the electric adjustment signals to an appropriate fluidic change.

Figure 2:
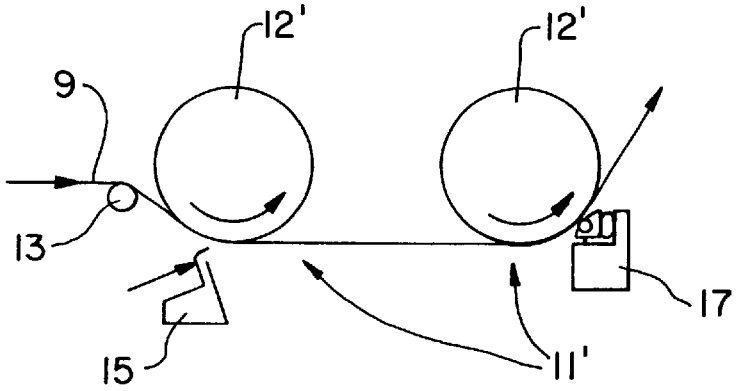
FIG. 2 is a schematic end view of the apparatus of FIG. 1, with a backing roll arrangement modified according to a second embodiment.

The following explains a second embodiment with the aid of FIG. 2. Similar or corresponding components as in the first embodiment relative to FIG. 1 are referenced identically, and reference is made to the explanations provided there. Moreover, the operating principle underlying the second embodiment corresponds to that of the first embodiment, so that reference is made here as well to the preceding explanations.

In the second embodiment according to FIG. 2, backing roll 12 of the first embodiment has been replaced by separate backing rolls 12', which now form an applicator system 11' along with applicator 15 and equalizer 17.The further components as in the first embodiment are present as well in the second embodiment, but have been omitted for reason of clarity. Applicator 15 is now coordinated with a backing roll 12', on the shell surface of which traveling paper web 9 is supported along a section of roll contact. At a distance, in the direction of paper web travel, equalizer 17 is coordinated with the other backing roll 12'supporting the paper web on its shell surface along a section of contact. Both backing rolls 12' rotate equidirectionally in arrow direction.

Figure 3:
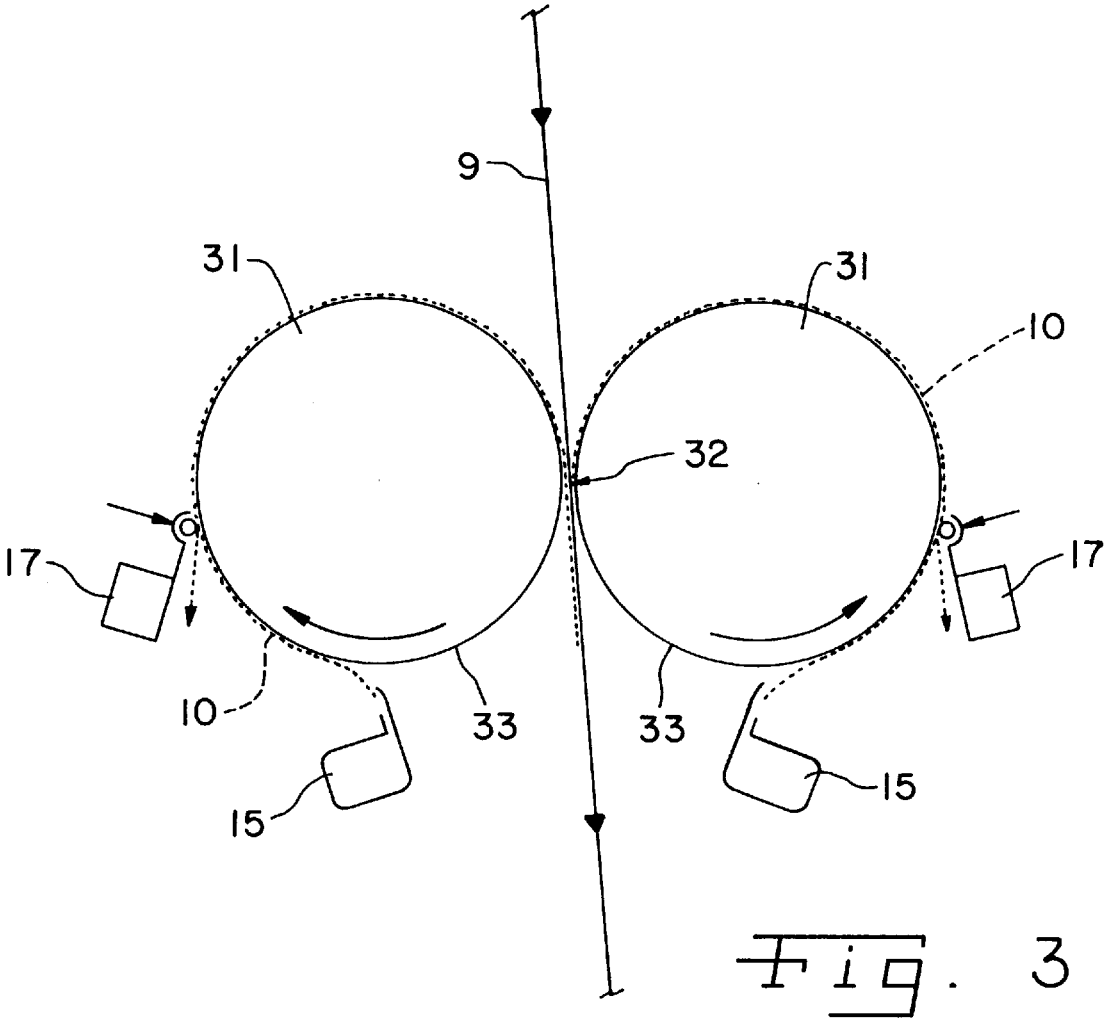
FIG. 3 is a schematic end view of a third embodiment of the inventional apparatus.

In the third embodiment relative to FIG. 3, the control loops with the measuring systems, controllers and adjustment apparatuses have been omitted in the drawing. Their configuration is analogous to the first embodiment, in FIG. 1, and reference is made to the explanations given there. While the two embodiments shown in FIG. 1 and 2 each relate to the direct application of the liquid or pasty medium 10 onto the surface of traveling material web 9, the third embodiment relates to the indirect application of the medium. Same or corresponding components as in the first embodiment relative to FIG. 1 are referenced identically, and reference is made to the explanations given there.

In the indirect application of medium 10 as illustrated in FIG. 3, the medium is applied first by applicator 15 on the shell surface 33 of an applicator roll 31 rotating in arrow direction. Medium 10 applied by applicator 15 thus first passes equalizer 17 with the rotation of applicator roll 31, before proceeding to a nip 32 with the continued rotation of applicator roll 31. The cross profile and length profile of applied medium 10 are controlled at applicator 15 and equalizer 17. Adjusted in its cross and length profile, applied medium 10 then proceeds on shell surface 33 of applicator roll 31 into the nip, or transfer nip 32, where it transfers to traveling material web 9 passing through the nip.

In the embodiment in FIG. 3, two applicator rolls 31 with pertaining applicators 15 and equalizers 17 are arranged symmetrically, forming between themselves nip 32. This arrangement is suited for a double-sided coating of material web 9. As an alternative thereto, one of the two applicator rolls 31 with applicator 15 and equalizer 17 can be replaced by a rotating backing roll which together with applicator roll 31 forms nip 32. Such arrangement is sufficient for a one-sided coating of material web 9.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for direct application of a coating medium onto a traveling fiber material web, said method comprising the steps of:

providing a revolving countersurface supporting the material web;

applying the medium onto a surface of the material web across a plurality of zones extending across a width of the material web, said surface being opposite said countersurface;

modifying, during said applying step, said cross profile of the medium across the material web width in said plurality of zones;

modifying, after said applying step, said length profile of the medium in a direction of travel of the web;

measuring a cross profile of the medium;

comparing said cross profile measurement to a first preset value in order to calculate a deviation;

converting said cross profile deviation to a first control command for modifying said cross profile;

controlling said cross profile of the medium during said first modifying step using said first control command;

measuring a length profile of the medium;

comparing said length profile measurement to a second preset value in order to calculate a deviation;

converting said length profile deviation to a second control command for modifying said length profile; and controlling said length profile of the medium during said second modifying step using said second control command, said second controlling step being independent from said first controlling step.

2. A method for indirect application of a coating medium onto a traveling fiber material web, said method comprising the steps of:

providing a revolving application substrate having a surface;

applying the medium onto said surface of said substrate;

transferring the medium from said surface to the material web in a nip through which the web passes, the medium being transferred across a plurality of zones extending across a width of the material web;

modifying, during said applying step, a cross profile of the medium across the material web width in said plurality of zones;

modifying, after said applying step, a length profile of the medium in a direction of travel of the web;

measuring said cross profile of the medium;

comparing said cross profile measurement to a first preset value in order to calculate a deviation;

converting said cross profile deviation to a first control command for modifying said cross profile;

controlling said cross profile of the medium during said first modifying step using said first control command;

measuring said length profile of the medium;

comparing said length profile measurement to a second preset value in order to calculate a deviation;

converting said length profile deviation to a second control command for modifying said length profile; and controlling said length profile of the medium during said second modifying step using said second control command, said second controlling step being independent from said first controlling step.

3. A method for direct application of a coating medium onto a traveling fiber material web, said method comprising the steps of:

providing a revolving countersurface supporting the material web;

applying the medium onto a surface of the material web across a plurality of zones extending across a width of the material web, said surface being opposite said countersurface;

modifying, during said applying step, under control, said length profile of the medium;

modifying, after said applying step, said cross profile of the medium in said plurality of zones in a direction of travel of the web;

measuring a length profile of the medium;

comparing said length profile measurement to a first preset value in order to calculate a deviation;

converting said length profile deviation to a first control command for modifying said length profile;

controlling said length profile of the medium during said first modifying step using said first control command;

measuring a cross profile of the medium;

comparing said cross profile measurement to a second preset value in order to calculate a deviation;

converting said cross profile deviation to a second control command for modifying said cross profile; and controlling said cross profile of the medium during said second modifying step using said second control command, said second controlling step being independent from said first controlling step.

4. A method for indirect application of a coating medium onto a traveling fiber material web, said method comprising the steps of:

providing a revolving application substrate having a surface;

applying the medium onto said surface of said substrate;

transferring the medium from said surface to the material web in a nip through which the web passes, the medium being transferred across a plurality of zones extending across a width of the material web;

modifying, during said applying step, under control, a length profile of the medium;

modifying, after said applying step, a cross profile of the medium in said plurality of zones;

measuring said length profile of the medium;

comparing said length profile measurement to a first preset value in order to calculate a deviation;

converting said length profile deviation to a first control command for modifying said length profile;

controlling said length profile of the medium during said first modifying step using said first control command;

measuring said cross profile of the medium;

comparing said cross profile measurement to a second preset value in order to calculate a deviation;

converting said cross profile deviation to a second control command for modifying said cross profile; and controlling said cross profile of the medium during said second modifying step using said second control command, said second controlling step being independent from said first controlling step.

5. A device for direct application of a coating medium onto a traveling fiber material web having a width, said device comprising:

a revolving countersurface supporting the fiber material web;

an applicator associated with said countersurface for applying the medium onto the web, said applicator including a metering system for the medium to be applied, said metering system being zonewise independently adjustable in a plurality of zones extending across the material web width;

an equalizer disposed after said applicator relative to a direction of web travel, said equalizer being associated with said countersurface, said equalizer including an overall adjustment apparatus adjustable in directions toward and away from said countersurface;

a measuring system associated with the material web, said measuring system configured for measuring a cross profile and a length profile of the medium applied on the web; and at least one electrical automatic controller, said at least one controller connected with said measuring system, said metering system and said overall adjustment apparatus, said at least one controller defining an independent cross profile control loop with said measuring system and said metering system for the medium, said at least one controller defining an independent length profile control loop with said measuring system and said overall adjustment apparatus for the medium.

6. An device for indirect application of a coating medium onto a traveling fiber material web having a width, said device comprising:

a revolving application substrate coordinated with a transfer nip through which the fiber material web passes;

an applicator for applying the medium onto said application substrate, said applicator including a metering system for the medium to be applied, said metering system being zonewise independently adjustable in a plurality of zones extending across the material web width;

an equalizer disposed after said applicator relative to a direction of web travel, said equalizer being associated with said revolving application substrate, said equalizer including an overall adjustment apparatus adjustable in directions toward and away from said application substrate;

a measuring system associated with the material web, said measuring system configured for measuring a cross profile and a length profile of the medium applied on the web; and at least one automatic controller, said at least one controller connected with said measuring system, said metering system and said overall adjustment apparatus, said at least one controller defining an independent cross profile control loop with said measuring system and said metering system for the medium, said at least one controller defining an independent length profile control loop with said measuring system and said overall adjustment apparatus for the medium.

7. The device of claim 6, wherein said equalizer includes a basic adjustment apparatus, said adjustment apparatus being zonewise independently adjustable across the material web width, said apparatus enabling a zonewise basic setting of said equalizer in a system start-up.

8. The device of claim 7, wherein said at least one controller comprises a separate cross profile controller associated with said cross profile control loop, and said at least one controller comprises a separate length profile controller associated with said length profile control loop.

9. A device for direct application of a coating medium onto a traveling fiber material web having a width, said device comprising:

a revolving countersurface supporting the fiber material web;

an applicator coordinated with said countersurface for applying the medium onto the web, said applicator including an overall metering system for the medium to be applied;

an equalizer disposed after said applicator relative to a direction of web travel, said equalizer being coordinated with said countersurface, said equalizer including an adjustment apparatus which is adjustable zonewise independently in a plurality of zones extending across the material web width;

a measuring system associated with the material web, said measuring system configured for measuring a cross profile and a length profile of the medium applied on the web; and an electrical automatic controller, said controller connected with said measuring system, said overall metering system, and said adjustment apparatus, said controller defining an independent length profile control loop with said measuring system and said overall metering system for the medium, said controller defining an independent cross profile control loop with said measuring system and said adjustment apparatus for the medium.

10. A device for indirect application of a coating medium onto a traveling fiber material web having a width, said device comprising:

a revolving application substrate coordinated with a transfer nip through which the fiber material web passes;

an applicator for applying the medium onto the application substrate, said applicator including an overall metering system for the medium to be applied;

an equalizer disposed after said applicator relative to a direction of web travel, said equalizer being coordinated with said application substrate, said equalizer including an adjustment apparatus which is adjustable zonewise independently in a plurality of zones extending across the material web width;

a measuring system associated with the material web, said measuring system configured for measuring a cross profile and a length profile of the medium applied on the web; and an automatic controller, said controller connected with said measuring system, said overall metering system and said adjustment apparatus, said controller defining an independent length profile control loop with said measuring system and said overall metering system for the medium, said controller forming an independent cross profile control loop with said measuring system and said adjustment apparatus for the medium.

11. The device of claim 10, wherein said applicator includes a basic metering system, said metering system being zonewise independently adjustable across the material web width, said metering system enabling a zonewise basic setting of said applicator in a system start-up.

12. The device of claim 11, wherein said controller comprises a separate cross profile controller coordinated with said cross profile control loop, and a separate length profile controller associated with said length profile control loop.

* * * * *